United States Patent [19]

Prescott

[11] Patent Number: 4,647,316

[45] Date of Patent: Mar. 3, 1987

[54] METAL BASE COATING COMPOSITION COMPRISING CHROMIUM, SILICA AND PHOSPHATE AND PROCESS FOR COATING METAL THEREWITH

[75] Inventor: Thomas J. Prescott, Troy, Mich.

[73] Assignee: Parker Chemical Company, Madison Heights, Mich.

[21] Appl. No.: 827,668

[22] Filed: Feb. 7, 1986

Related U.S. Application Data

[63] Continuation of Ser. No. 726,935, Apr. 26, 1985, abandoned, which is a continuation of Ser. No. 592,591, Mar. 23, 1984, abandoned.

[51] Int. Cl.[4] ..... C23F 7/08

[52] U.S. Cl. ..... 148/6.16; 148/31.5

[58] Field of Search ..... 148/6.16, 31.5

[56] References Cited

U.S. PATENT DOCUMENTS

| | | | |
|---|---|---|---|
| 2,529,206 | 11/1950 | Winslow | 148/6.16 |
| 3,462,319 | 8/1969 | Campell | 148/6.16 |
| 3,556,869 | 1/1971 | | |
| 3,562,011 | 2/1971 | Hirst | 148/6.16 |
| 3,720,549 | 3/1973 | Hirst | 148/6.16 |
| 3,798,074 | 3/1974 | Esler | 148/6.16 |
| 4,169,741 | 10/1979 | Lampatzer | 148/6.16 |

FOREIGN PATENT DOCUMENTS

| | | | |
|---|---|---|---|
| 0060076 | 8/1982 | Japan | 148/6.16 |
| 8401954 | 5/1984 | PCT Int'l Appl. . | |
| 1540435 | 2/1979 | United Kingdom . | |
| 2013726 | 8/1979 | United Kingdom . | |
| 1552345 | 9/1979 | United Kingdom . | |
| 1559118 | 1/1980 | United Kingdom . | |
| 1563979 | 4/1980 | United Kingdom . | |
| 2044806 | 10/1980 | United Kingdom . | |
| 2097430 | 11/1982 | United Kingdom . | |
| 2141143 | 12/1984 | United Kingdom . | |

*Primary Examiner*—Sam Silverberg

*Attorney, Agent, or Firm*—Arthur E. Kluegel

[57] ABSTRACT

Disclosed is an aqueous metal treatment composition comprising: (a) a hexavalent chromium compound; (b) a compound selected from the group consisting of silica and silicates and mixtures thereof and (c) phosphate. Preferably, the composition also comprises trivalent chromium compound and the respective weight ratios of hexavalent chromium, trivalent chromium, compound selected from the group consisting of silica and silicates and mixtures thereof, and phosphate to 1.0 total chromium by weight are from about 0.6 to 1.0; from 0.0 to about 0.4; from about 0.5 to about 5.0; and from about 0.1 to about 5.0, respectively. A metal surface can be coated with the aqueous metal treatment composition and then cured to provide a coated metal product having good corrosion resistance, paint adhesion characteristics and formability.

10 Claims, No Drawings

METAL BASE COATING COMPOSITION COMPRISING CHROMIUM, SILICA AND PHOSPHATE AND PROCESS FOR COATING METAL THEREWITH

This application is a continuation of application Ser. No. 726,935, filed Apr. 26, 1985 now abandoned which is a continuation of application Ser. No. 592,591 filed Mar. 23, 1984 now abandoned.

BACKGROUND OF THE INVENTION

This invention relates to an improved composition and process for coating metal surfaces and more particularly relates to an improved composition and process for applying a protective base coating to metallic surfaces for subsequent painting. The composition and process of this invention is especially useful for base coating cold rolled steel metal surfaces.

The need for applying base coatings to metal surfaces has long been recognized in the art. One of the most important uses of base coatings is as a base for subsequent painting. Under these circumstances, the user will look to the adhesion of the paint to the metallic surface, as well as the resistance of the painted surface to humidity, salt-spray and similar tests in order to determine the corrosion quality of the painted article. Where forming is to be employed subsequent to painting, the user will also be concerned with the formability of the metal and the corrosion resistance of the metal after the metal has been formed.

In the past, difficulties have often been encountered in developing a composition and method for treating metal surfaces which produces an end product which, when painted, exhibits satisfactory formability adhesion and corrosion characteristics. High coating weights were required for corrosion protection while low coating weights were required for formability. Generally speaking, conventional compositions and methods for treating metal surfaces have involved multi-stage chemical treatments of the metal with water rinsing after each treatment. However, multiple-stage treating involves additional personnel, inter-stage contamination problems, extended line length, and problems with regard to disposal of rinse water.

The present invention provides a single-application, no rinse, composition and method for the treatment of bare metal surfaces for the purposes of forming a corrosion-resistant base coating thereon. The base coating of the present invention provides satisfactory corrosion protection at a low coating weight while still providing satisfactory formability. The improved coating may be provided on various metal surfaces, but is especially useful on cold rolled steel. The coating imparts to the metal a high degree of corrosion resistance and paint applied thereto is satisfactorily adherent. The process of the present invention minimizes inter-stage contamination problems, line length and problems associated with disposal of process chemicals.

Further understanding of the present invention will be had from the following description and claims. All parts and percentages herein are by weight unless otherwise indicated.

SUMMARY OF THE INVENTION

In accordance with the present invention, an aqueous metal treatment composition comprises: (a) a hexavalent chromium compound; (b) a compound selected from the group consisting of silica and silicates and mixtures thereof and (c) phosphate. Preferably, the composition also comprises a trivalent chromium compound and the respective weight ratios of hexavalent chromium, trivalent chromium, compound selected from the group consisting of silica and silicates and mixtures thereof, and phosphate to 1.0 total chromium are from about 0.6 to 1.0; from 0.0 to about 0.4; from about 0.5 to about 5.0; and from about 0.1 to about 5.0, respectively. In accordance with the process of this invention, a metal surface is coated with the foregoing aqueous metal treatment composition which is then cured to provide a coated metal product of this invention.

DESCRIPTION OF THE PREFERRED EMBODIMENTS

An aqueous metal treating composition of the present invention comprises (a) a hexavalent chromium compound; (b) a compound selected from the group consisting of silica and silicates and mixtures thereof; (c) phosphate; and optionally and preferably, (d) a trivalent chromium compound.

The phosphate and chromium components of the present invention may be supplied in any form which does not interfere with the quality of the final paint base coating. Addition in the form of alkali metal salts should be minimized and preferably avoided since such salts may interfere with the quality of the coating. The phosphate and hexavalent chromium are preferably added as relatively soluble di- or trivalent metal salts, thermally stable ammonium or amine salts (including double salts with the foregoing metals), or in acid form. Suitable di- or trivalent metals include salts of, for example, zinc, manganese, chromium, nickel, cobalt and iron. The chromium component is preferably added as zinc dichromate or chromic anhydride (chromic acid) and the phosphate component is preferably added as zinc dihydrogen phosphate or as phosphoric acid. Hexavalent chromium is employed herein in a weight ratio of from about 0.6:1.0 total chromium up to 1.0:1.0 total chromium and is preferably employed in a weight ratio of from about 0.75:1.0 total chromium up to 1.0:1.0 total chromium. Phosphate is employed herein in a weight ratio of from about 0.1:1 total chromium up to about 5.0:1 total chromium, and preferably from about 0.1:1 total chromium up to about 1.0:1 total chromium.

The silica or silicate must be one capable of dissolving in the aqueous composition or becoming dispersed therein to form a homogeneous, that is colloidal, dispersion. It is therefore preferably used in a finely-divided form. The use of fume or precipitated silica, is preferred, but naturally-occurring ground quartz and diatomaceous earth may also be used when the necessary dispersion can be obtained. There may also be used silicates such as montmorillonite or synthetic flurosilicates, such as complex magnesium fluorosilicates sold under the trade name Laponite. The use of soluble sodium or potassium silicates and fluorosilicates is much less preferred since they tend to form glassy coatings with poor adhesion and therefore the use of a water-insoluble silica or silicate that is nevertheless colloidally dispersible in the solution is preferred. Mixtures of different forms of silica and/or different silicates may be used if desired. The compound selected from the group consisting of silica and silicates and mixtures thereof is employed herein in a weight ratio of from about 0.5:1 total chromium up to about 5.0:1 total chromium and preferably from about 1.0:1 total chromium up to about 3.0:1 total chromium.

The trivalent chromium compound can be prepared by the partial reduction of an aqueous solution of chromic acid with starch and heat in a conventional manner such as is disclosed, for example, in U.S. Pat. No. 3,706,603, Dec. 10, 1972 to Vessey, et al. The partially reduced solution will, of course, contain both hexavalent and trivalent chromium compounds.

In addition to the above components, additional components may be optionally included in the composition of this invention, such as metal di- and trivalent cations such as zinc, manganese, cobalt, nickel and iron; inert coloring agent designed to provide a specific color to the protective coating; silicon compounds; a conductive material to improve weldability such a pulverulent metal as disclosed in U.S. Pat. No. 3,671,331 or a conductive carbon as disclosed in copending U.S. application Ser. No. 399,646; and emulsifying agents necessary to maintain the resin component in a dispersed state (normally present in commercially available resin aqueous dispersions).

The aqueous composition of the invention may be used without any need for pH adjustment. Where the components are added in the form of di- and trivalent metal salts or as the acids, pH's of below 2.5 will normally be expected. On the other hand, of the components are added as the ammonium or amine salts, less acid pH's will be expected.

The working composition may be prepared by mixing the essential ingredients in any order to provide the desired weight ratios. However, the silica or silicate is preferably added after partial reduction of hexavalent chromium if heat is employed during the reduction since heat may reduce the disbursable nature of the silica. Since no substantial reaction with the metal surface takes place prior to curing, the components of a film deposited from the bath are initially present in the same concentration as in the bath. Therefore, the concentration of the essential components in a replenishing composition will be substantially the same as in the working composition. This fact simplifies bath control and improves product uniformity.

Depending on the method of application, a wide range of concentrations could be employed herein. A working solution can, for example, comprise from about 0.8% to about 12.0% total chromium and will usually comprise from about 0.8% to about 8.0% total chromium.

The aqueous composition of the present invention is especially useful for dry-in-place stripline application to cold rolled steel to provide improved corrosion protection and formability for painted stock. However, the composition may also be used over aluminum, zinc, galvanized steel, other ferrous metal surfaces, and alloys thereof.

Application of the aqueous composition to the metal surface may be accomplished in any of the conventional manners so long as sufficient care is taken to obtain a reasonably uniform thickness of the aqueous film. For flat surfaces such as sheet or strip, this control may be accomplished most readily through the use of rollers, or squeegees, however, the composition may be applied by any suitable conventional method such as electrostatic coating or mist-on techniques.

Coating weights may vary from as little as one milligram per square foot to as much as 400 milligrams per square foot or higher. Normally, the coating weight will be between 5 and 100 milligrams per square foot. Coating weights for aluminum surfaces will typically be between about 5 mg/ft$^2$ and about 15 mg/ft$^2$, while for ferrous surfaces the coating weight will typically be between about 15 mg/ft$^2$ and about 25 mg/ft$^2$ and for zinc between about 10 mg/ft$^2$ to about 20 mg/ft$^2$.

In operation, processing variables will normally be determined based upon the desired coating weight to be obtained. Depending upon the overall concentration of the components in the working composition, a film of predetermined thickness of the aqueous treating composition will be applied to the metal surface from a working bath and then cured by heating. As the surface is cured, the composition becomes concentrated and a reaction will begin to take place between the components of the composition and the metal surface to from the coating of this invention. Normal ambient temperatures are suitable for the working bath. However, the working bath and/or the metal surface may be preheated in order to hasten the curing process.

Metal temperatures of up to 200° F. or higher may be employed for immersion or roll-on applications without degrading the bath. Higher temperatures may be employed in connection with mist-on application. The manner of curing is not critical so long as the liquid film is not unduly disrupted, e.g., but hot air currents or physical contact during the curing process. However, the manner of curing may affect the temperature required to effect a cure. For example, curing is obtained at lower peak metal temperatures in an infra red oven than in a conventional oven. Under normal operations, it is desirable to use elevated oven temperatures and warm air streams of velocity insufficient to disturb the wet film. From a practical standpoint, the oven temperature should result in a metal temperature of between about 125° and 325° F.

The paint can be applied to the cured coated surface by any conventional means. While the particular paint employed will affect the over-all corrosion resistance and adhesion, with most commercial paints tested, the process of this invention will give results comparable to those obtained by conventional two or three-stage base coat processes.

Further understanding of the present invention will be had from the following examples which are intended to illustrate, but not limit, this invention.

EXAMPLE 1

A treatment solution is made up from a solution of chromic anhydride ($CrO_3$); partially reduced chromic anhydride ($Cr^{+6}$; $Cr^{+3}$=60:40 from reduction of $CrO_3$ with starch and heat); phosphoric acid, and a 10% w/v solution of Aerosil 200 silica (milled in $H_2O$ to form a suspension) to give $Cr^{+6}$: $PO_4$: $SiO_2$: $Cr^{Total}$weight ratios of 0.87:0.97:2.0:1.0, respectively. The solution was applied to cold rolled steel panels by means of a grooved squeegee roll at coating weights of both 37 and 17 mg/ft$^2$ with the coating being cured by drying the treated panels in a conventional oven to a peak metal temperature of approximately 180°–200° F. The panels sat for about 2 weeks. Then some panels were painted with a single coat of polyester paint, some panels with a single coat of vinyl and some panels with a 2 coat epoxy-polyester system. All panels had good paint adhesion corrosion protection and formability.

EXAMPLE 2–4

Four treatment solutions were prepared as in Example 1 to the following $Cr^{+6}:PO_4:SiO_2:Cr^{Total}$ ratios:

| Example 2 | Example 3 | Example 4 |
|---|---|---|
| 0.6:0.32:2.0:1.0 | 0.6:0.65:2.0:1.0; | 0.6:0.97:2.0:1.0 |

Coatings were again applied as in Example 1 to cold rolled steel panels which coated panels were then dried to 180°–200° F. peak metal temperature in a conventional oven before painting as in Example 1. Comparison of the panels of Examples 2–4 found that corrosion protection (salt spray) improved but formability diminished as the $PO_4$ level was increased.

EXAMPLE 5

Cold rolled steel panels were treated with 20 mg/ft$^2$ coatings from a solution made as in Examples 1 to give a $Cr^{+6}$: $PO_4:SiO_2:Cr^{Total}$ ratio of 0.93:0.32:2.0:1.0 using the previously mentioned grooved rolled squeegee coater. The panels were cured in a conventional convection oven at 300° F. peak metal temperature and after 30 seconds cooling-off period in a room temperature environment were painted as in Example 1. All panels had good corrosion resistance, paint adhesion characteristics and formability.

EXAMPLE 6

The solution of Example 5 was applied to a surface of cold rolled steel panels which had been preheated to about 200° F. After about 1 minute the panels were painted with a single coat of polyester paint or a two coat epoxy primer polyester top coat with excellent corrosion resistance, paint adhesion and formability being obtained.

What is claimed is:

1. An aqueous composition for treating a metallic surface comprising:

(a) a hexavalent chromium in a weight ratio of hexavalent chromium to total chromium from about 6:10 to 1.0:1.0.

(b) a compound selected from the ground consisting of silica and silicates and mixtures thereof in a weight ratio to total chromium of from about 1.0:1.0 to about 3.0:1; and (c) phosphate in a weight ratio to total chromium of from about 0.1:1.0 to about 1.0:1.0.

2. An aqueous composition as in claim 1 comprising in addition, a trivalent chromium compound.

3. An aqueous composition as in claim 1 wherein the weight ratio of hexavalent chromium to total chromium is from about 0.75:1.0 to 1.0:1.0.

4. An aqueous composition as in claim 1 wherein said hexavalent chromium compound, compound selected from the group consisting of silica and silicates and mixtures thereof and phosphate are present in respective weight ratios to 1.0 total chromium of from about 0.90 to about 0.95; from about 1.5 to about 2.5; and from about 0.25 to about 0.50.

5. An aqueous composition as in claim 1 wherein said total chromium is present in an amount of from about 0.8% to about 28%

6. A process of treating a metal surface comprising the step of providing an aqueous coating on a metal surface comprising:

(a) a hexavalent chromium in a weight ratio of hexavalent chromium to total chromium from 6:10 to 1.0:1 total chromium of from about 1.0:1.0 to about 3.0:1.0; and (c) phosphate in a weight ratio to total chromium of from about 0.1 to about 1.0:1;

and then during said coating.

7. The process of claim 6 wherein said aqueous coating comprises, in addition, a trivalent chromium compound.

8. The process of claim 6 wherein the weight ratio of hexavalent chromium to total chromium is from about 0.75:1.0 to 1.0:1.0.

9. The process of claim 6 wherein at least a portion of said metal surface is cold rolled steel.

10. A coated metal surface made by the process of claim 9.

* * * * *

UNITED STATES PATENT AND TRADEMARK OFFICE

CERTIFICATE OF CORRECTION

PATENT NO. : 4,647,316

DATED : March 3, 1987

INVENTOR(S) : Thomas J. Prescott

It is certified that error appears in the above-identified patent and that said Letters Patent is hereby corrected as shown below:

Column 3, Line 27 "of" should be --if--;

Column 4, Line 17 "from" should be --form--;

Column 4, Line 27 "but" should be --by--;

Column 4, Line 53 "$Cr^{+6}$;" should be --$Cr^{+6}$:--;

Column 6, Line 4 "ground" should be --group--;

Column 6, Line 7 "3.0:1" should be --3.0:1.0--;

Column 6, Line 24 "28%" should be --12%--;

Column 6, Line 30 "1.0:1" should be --1.0:1.0--;

Column 6, Line 30-31 delete "total chromium of from about 1.0:1.0 to about 3.0:1.0; and";

Column 6, Line 32 Insert the following paragraph:
-- (b) a compound selected from the group consisting of silica and silicates and mixtures thereof in a weight ratio to total chromium of from about 1.0:1.0 to about 3.0:1.0; and --;

Column 6, Line 33 "0.1" should be --0.1:1.0--;

UNITED STATES PATENT AND TRADEMARK OFFICE

CERTIFICATE OF CORRECTION

PATENT NO. : 4,647,316

DATED : March 3, 1987

INVENTOR(S) : Thomas J. Prescott

It is certified that error appears in the above-identified patent and that said Letters Patent is hereby corrected as shown below:

Column 6, Line 34 "during" should be --curing--.

Signed and Sealed this

Sixth Day of October, 1987

*Attest:*

DONALD J. QUIGG

*Attesting Officer*

*Commissioner of Patents and Trademarks*